US005810081A

United States Patent [19]

Cobb et al.

[11] Patent Number: 5,810,081

[45] Date of Patent: Sep. 22, 1998

[54] WEAR STRUCTURE FOR BORE HOLE SEPARATION DEVICE

[76] Inventors: Delwin E. Cobb, 2323 Parana Dr., Houston, Tex. 77080; Roy S. Arterbury, 220 Caruthers, Houston, Tex. 77024

[21] Appl. No.: 806,238

[22] Filed: Feb. 24, 1997

[51] Int. Cl.[6] ..... E21B 43/38

[52] U.S. Cl. ..... 166/105.3; 166/105.5

[58] Field of Search ..... 166/357, 105.5, 166/105.1, 105.3, 68; 55/455, 205

[56] References Cited

U.S. PATENT DOCUMENTS

| | | | |
|---|---|---|---|
| 3,887,342 | 6/1975 | Bunnelle | 166/105.5 X |
| 4,481,020 | 11/1984 | Lee et al. | 166/105.5 X |
| 4,531,584 | 7/1985 | Ward | 166/105.5 X |
| 4,828,036 | 5/1989 | Simmons | 166/105.5 X |
| 5,314,018 | 5/1994 | Cobb | 166/265 |
| 5,516,360 | 5/1996 | Normandeau et al. | 166/105.5 X |

*Primary Examiner*—Frank Tsay
*Attorney, Agent, or Firm*—Bush, Riddle & Jackson

[57] ABSTRACT

A separation device or desander (18) is positioned in a bore hole for separation of solid particles from well fluids and includes outer and inner concentric members (20 and 22) defining an annulus (30) therebetween. A spiral guide (32) is positioned in annulus (30) between the concentric tubular members (20, 22). A wear structure comprising the present invention includes a flat (38) in the outer wall (27) of the outer tubular member (20) to provide a reduced thickness wall portion thereat. Upon wear from abrasive solid particles, and opening (40) is formed at the reduced thickness cutaway portion defined by flat (38). A sleeve (46) may be mounted within the outer tubular member (20) below the inner tubular member (22).

12 Claims, 1 Drawing Sheet

WEAR STRUCTURE FOR BORE HOLE SEPARATION DEVICE

FIELD OF THE INVENTION

This invention relates to a downhole separation device for the separation of sand and other solid particles from well fluids, and more particularly to a wear structure for such a separation device.

BACKGROUND OF THE INVENTION

When large quantities of sand flow into the well bore, it is desirable to stop or reduce the sand flow. Various sand control systems have been utilized heretofore to stop or reduce the sand flow into the well bore. However, even with sand control systems, in many instances sand or other solid particles are entrained with a liquid pumped through a downhole pump. Screens or filter openings have been utilized heretofore in the casing or other members to restrict the flow of solid particles. However, if the filter openings are too small, the openings will eventually become plugged, and if the filter openings are too large solid particles will flow through the openings. In many wells, the quantity of sand flowing from the formation is relatively small but sufficient to wear or plug the downhole pump. The sand flow is often relatively large each time the pump is started, but is reduced or ceases after a time period of continuous flow. For example, gravel packs are widely used to keep sand from flowing into the well bore. While gravel packs may be utilized in a satisfactory manner to restrict the flow of sand in some formations, they are not effective in other types of formations. In such formations, the wells have to be pumped at a low rate to reduce the amount of flowing sand and if the production rate is not sufficient to justify the high maintenance cost then such a well is usually abandoned.

U.S. Pat. No. 5,314,018 dated May 24, 1994 shows a separation device positioned on the lower end of a downhole tubing string. The separation device is adapted for use particularly in wells that flow large amounts of sand during start up, and in wells that flow small amounts of sand continuously. The storage or collection volume in the well below the separation device is usually limited.

A spiral guide is utilized in the separation device of U.S. Pat. No. 5,314,018 and is positioned in an annular chamber between an outer tubular member and a concentric inner tubular member. The spiral guide in the annular chamber is effective to guide the well fluids containing entrained solid particles downwardly in a spiral path to impart a helical motion to the solid particles so that the solid particles settle downwardly and the separated well fluid is pumped upwardly through the inner tubular member. The inner tubular member has a lower end portion projecting downwardly for a relatively short distance below the lower end of the spiral guide.

The fluid rotates at a relatively fast speed. It has been found, when the unit is full of sand and continues to operate for long periods of time, the sand particles abrade the inner surface of the outer tubular member a few inches below the inner spiral tube. When wear along the inner surface of the outer tubular member occurs from such sand particles under continuous rotation for prolonged periods of time, such as a year, the wall of the outer pipe or tubular member may be worn through along an entire circumferential surface, and failure of the outer tubular member is possible under certain conditions.

It is desired that a wear structure be provided for the outer tubular member so that wear may be effected without failure of the outer tubular member. In the event of failure, the tubing below the separation device must be removed and the length of such tubing may be as much as around 600–1000 feet.

SUMMARY OF THE PRESENT INVENTION

The present invention is particularly directed to a wear structure for a separation device positioned on the lower end of a downhole tubing string and adapted for use particularly in wells that flow sand particles during start-up or during production. The separation device includes inner and outer concentric tubular members providing an annulus in which a spiral guide is positioned below a fluid inlet passage in the wall of the outer tubular member which receives fluids with entrained solid particles such as sand therein for separation. The fluid including the entrained solid particles moves downwardly in the annulus in a spiral path which provides a helical motion to the solid particles.

The wear structure comprising the present invention is provided in the outer surface of the outer tubular member at a location below the fluid inlet passage in the outer tubular member and extends below the lower end of the inner tubular member. The wall of the outer tubular member has an outer cutaway portion therein to define a reduced wall thickness which forms a weakened wall portion. The swirling action of the sand with relatively abrasive sand particles for prolonged periods of time will effect wear at the weakened wall portion and possible wear through the wall at the weakened wall portion to form a secondary fluid inlet through the wall to the annulus. The cutaway portion preferably comprises a flat on the outer surface of the outer tubular member which reduces the thickness of the wall and when wear occurs from the inner surface of the outer tubular member through the reduced thickness portion, an opening at the reduced thickness portion is formed to relieve wear as fluids and entrained particles flow into the annulus at the opening. It is apparent that various types of wear structures could be provided to provide a weakened wall portion, such as a slot, or groove.

Other objects, features, and advantages of this invention are apparent from the following specification and drawings.

DESCRIPTION OF THE INVENTION

Figure 1:
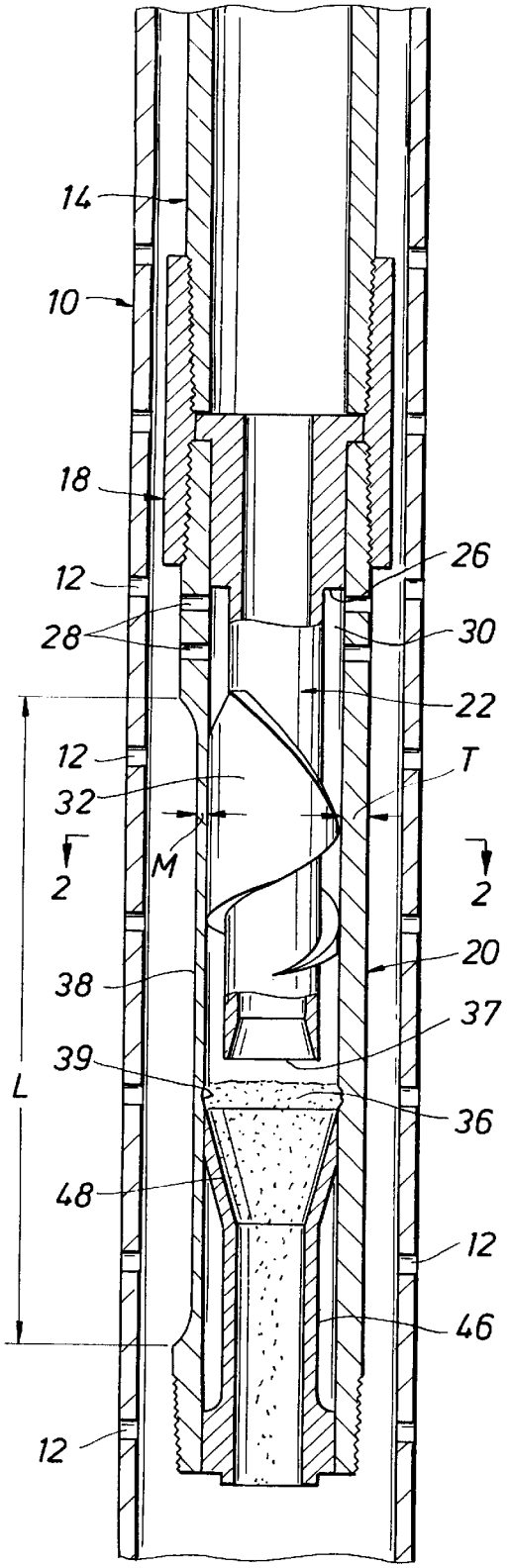
FIG. 1 is a sectional view of a tool string connected to the lower end of a tubing string mounted in a casing of a well bore and including a separation device having the wear structure comprising the present invention thereon.

Referring now particularly to FIG. 1 of the drawings, an outer casing is shown generally at 10 positioned within a well bore and having perforations 12 therein for the entry of well fluids including entrained solid particles from the adjacent formation. Mounted within casing 10 is a lower end of a tubing string shown generally at 14 and extending upwardly to a surface location. Separation device or desander 18 includes an outer tubular member generally indicated at 20 and a concentric inner tubular member generally indicated at 22. The upper end of inner tubular member 22 includes an annular shoulder 26 and a plurality of openings 28 are provided in outer tubular member 20 below shoulder 26. Openings 28 extend through the wall 27 of outer tubular member 20. Openings 28 act as a screen or filter to prevent large solid particles from entering annular chamber 30 formed between outer tubular member 20 and inner tubular member 22.

Mounted in annular chamber 30 between inner tubular member 22 and outer tubular member 20 is a spiral guide generally indicated at 32 and having upper and lower helical surfaces thereon to provide a helical motion to the fluid and entrained solid particles therein. Spiral guide 32 may be of various shapes and dimensions to provide a spin or helical motion to the well fluids and solid particles therein. As an example of a suitable spiral guide, reference is made to U.S. Pat. No. 5,314,018 dated May 24, 1994, the entire disclosure of which is incorporated by this reference. The solid particles settle downwardly in a vortex or swirl chamber 36 shown below the lower end 37 of inner tubular member 22. Wear or erosion occurs along the inner surface of outer tubular member 20 in swirl chamber 36 from the solid particles contacting the inner surface of outer tubular member 20 as indicated at 39 in FIG. 1. The entrained solid particles, particularly when comprising hard, sharp and abrasive sand particles of a size between five (5) mils and seventy-five (75) microns result in a substantial wear upon continuous use for a prolonged time period, such as one year with the sand spinning or swirling at high speeds in substantially the same location.

Figure 2:
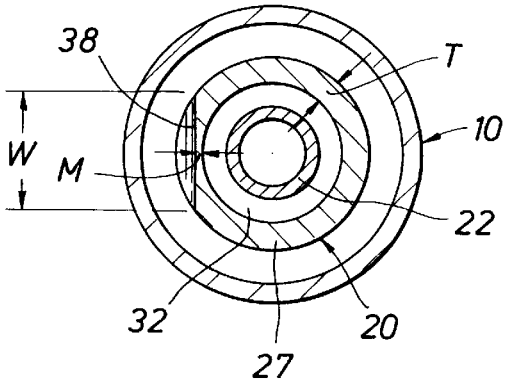
FIG. 2 is a section taken generally along line 2—2 of FIG. 1 and showing a flat on the outer surface of the outer tubular member to provide a weakened wall portion in the outer tubular member.
Figure 3:
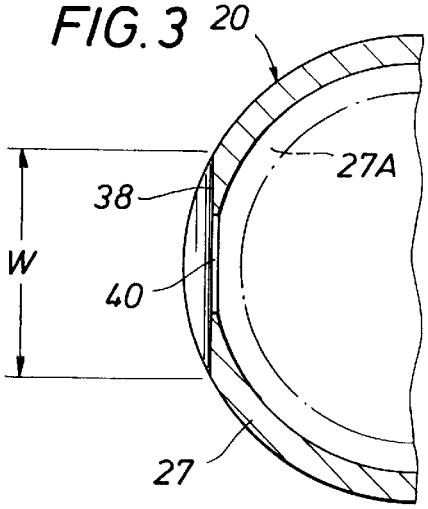
FIG. 3 is an enlarged cross sectional view of a portion of the outer tubular member having a flat thereon with an inner portion of the wall being worn away at the flat portion to provide an opening through the wall at the flat portion.

To provide a relief for such wear or erosion, a flat shown at 38 in FIG. 2 in the tubular wall of tubular member 20 provides a weakened wall portion thereat. As shown in FIG. 3, an inner portion of the wall 27 is worn away as indicated by the broken line portion shown at 27A. As a result, an opening 40 is formed in reduced thickness M as indicated and well fluids along with the entrained sand particles enter through opening 40 to restrict substantially the swirling action of the sand to relieve the wear. Opening 40 is enlarged by the abrasive action of the entrained sand and results in a reduction of fluid pressure through fluid inlet openings 28. Further, sufficient wall thickness remains in the remainder of wall 27 to transfer loads from the tool string without any failure of tubular member 20. Flat 38 forms a cutaway portion in wall 27 which has a thickness "T". Flat 38 at the center of its width "W" has a minimal thickness "M" which preferably is about fifty percent (50%) of the wall thickness "T". Minimal thickness "M" may be between about twenty percent (20%) and eighty percent (80%) of wall thickness "T" and obtain satisfactory results. The minimum thickness "M" is at least about one-sixteenth inch (1/16") and flat 38 has a minimum length "L" of at least about two inches (2"). An optimum length of flat 38 is preferably about twelve to fifteen inches (12"–15") and the upper end of flat 38 is spaced at least one inch (1") below inlet openings or passages 28. Opening or hole 40 is formed by wear or erosion of thickness M.

It may be desirable, under certain conditions such as when separating powder sand having a particle size less than three (3) mils, that a funnel or sleeve shown at 46 in FIG. 1 be mounted in outer tubular member 20 beneath the lower end 37 of inner tubular member 22. Sleeve 46 has an upper conical end or taper at 48 and is effective to direct the solid particles downwardly in swirl chamber 36. Sleeve 46 is effective to control the length of swirl chamber 36 and thereby restrict the wear area to a predetermined area. The primary wear area is formed adjacent the upper end of sleeve 46 as indicated at 39 in FIG. 1. Upon the formation of hole 40, the swirling action of the sand in swirl chamber 36 is substantially reduced and may stop. Thus, any further wear except the enlargement of opening 40 is substantially stopped.

Figure 4:
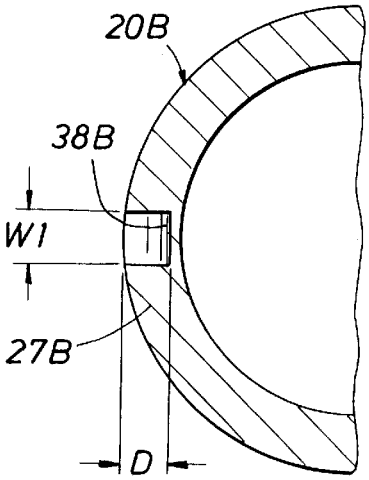
FIG. 4 is an enlarged section view of a modification of the present invention in which a slot is provided in the outer surface of the outer tubular member to provide a weakened wall portion thereat.

A weakened wall portion may be provided by various types of structures such as cuts, slots, or grooves for example. As shown in FIG. 4, a separate embodiment of a weakened portion is shown in which the cutaway portion comprises a slot 38B cut in wall 27B of outer tubular member 20B. Slot 28B has a minimal width "W1" of about one-sixteenth inch (1/16") and has a minimum depth "D" of a least one-sixteenth inch (1/16").

While preferred embodiments of the present invention have been illustrated in detail, it is apparent that modifications and adaptations of the preferred embodiments will occur to those skilled in the art. However, it is to be expressly understood that such modifications and adaptations are in the spirit and scope of the present invention as set forth in the following claims.

What is claimed is:

1. In a tool string having a tubular body for removing fluids from a well; a separation device connected to said tubular body adjacent the lower end thereof for separating solid particles from said fluids, said separation device comprising:

an outer tubular member and a concentric inner tubular member defining an annulus between said inner and outer members;

a fluid inlet passage in said outer tubular member extending to said annulus and restricting large solid particles from entering said annulus through said fluid inlet passage;

means blocking fluid flow upwardly from said annulus; and spiral guide means in said annulus between said tubular members and below said fluid inlet passage for directing solid particles received from said fluid inlet passage downwardly in a helical motion for settling of said solid particles below said inner tubular member with the separated fluid flowing upwardly through said inner tubular member to a separate location;

said outer tubular member having a wall and a portion of said wall has a reduced wall thickness which forms a weakened wall portion, said outer tubular member when exposed to relatively abrasive swirling solid particles for a prolonged period of time causing erosion of said weakened wall portion to reduce the thickness of said wall thereat.

2. In a tool string as set forth in claim 1;

said weakened wall portion comprising an axially extending flat along said wall, arranged so that substantial wear of said outer tubular member along the inner wall surface of said outer tubular member results in wearing through said reduced wall thickness to form an opening thereat to limit the swirling action and relieve the erosion.

3. In a tool string as set forth in claim 2;

said opening being enlarged upon prolonged use thereof by abrasive solid particles passing through said opening, the fluid flow through said fluid inlet passage being reduced upon formation of said opening.

4. In a tool string as set forth in claim 1 wherein:

at least about twenty percent (20%) of said original wall thickness is removed at said weakened wall portion.

5. In a tool string as set forth in claim 1 wherein;

said weakened wall portion being positioned at least about one inch (1") below said fluid inlet passage and having an axial length at least about two inches (2").

6. In a tool string as set forth in claim 1 wherein;

said weakened wall portion comprises a flat formed on the outer surface of said outer tubular member.

7. In a tool string as set forth in claim 1 wherein:

said weakened wall portion comprises an axially extending slot in the outer surface of said outer tubular member.

8. In a tool string as set forth in claim 1 wherein:

a swirl chamber is formed adjacent the lower end of said inner tubular member and said reduced wall thickness extends below said swirl chamber.

9. In a tool string having a tubular body for removing fluids from a well; a separation device connected to said tubular body adjacent the lower end thereof for separating solid particles from said fluids; said separation device comprising:

an outer tubular member and a concentric inner tubular member defining an annulus between said inner and outer members;

a fluid inlet passage in said outer tubular member extending to said annulus and restricting large solid particles from entering said annulus through said fluid inlet passage;

means blocking fluid flow upwardly from said annulus;

spiral guide means in said annulus between said tubular members and below said fluid inlet passage for directing solid particles below said inner tubular member with the separated fluid flowing upwardly through said inner tubular member to a separate location;

a sleeve having an inwardly tapering upper end portion mounted in said outer tubular member beneath said inner tubular member for receiving solid particles separated by said separation device; and a swirl chamber formed in said outer tubular member between the lower end of said inner tubular member and said upper end portion of said sleeve;

said outer tubular member adjacent said swirl chamber having a weakened wall portion; said outer tubular member when exposed to relatively abrasive swirling solid particles in said swirl chamber for a prolonged period of time causing erosion of said weakened wall portion to reduce the thickness of the wall of said outer tubular member defining said swirl chamber.

10. In a tool string as set forth in claim 9 wherein:

said weakened wall portion is arranged so that substantial wear of the inner surface of said outer tubular member at the swirl chamber results in wearing through said reduced wall portion to form an opening thereat providing fluid flow into the swirl chamber thereby to limit the swirling action of the solid particles within the swirl chamber.

11. In a tool string as set forth in claim 10 wherein:

said weakened wall portion comprises a flat formed in the outer surface of said outer tubular member adjacent the swirl chamber.

12. In a tool string as set forth in claim 10 wherein:

said weakened wall portion comprises an axial slot formed in the outer surface of said outer tubular member adjacent said swirl chamber.

* * * * *